US005143583A

United States Patent [19]

Marchessault et al.

[11] Patent Number: 5,143,583

[45] Date of Patent: Sep. 1, 1992

[54] PREPARATION AND SYNTHESIS OF MAGNETIC FIBERS

[76] Inventors: Robert H. Marchessault, 611 Ave. du Boise, #9k, Montreal, Quebec H3S 2V8; Patrice Rioux, 6177, rue Albanie, Brossard, Québec J4Z 1G5; Serge Ricard, 3962, 32 ième Avenue, Shawinigan, Québec G9N 5Z8, all of Canada

[21] Appl. No.: 679,105

[22] Filed: Apr. 2, 1991

[51] Int. Cl.[5] ..... D21H 17/70

[52] U.S. Cl. ..... 162/138; 162/146; 162/157.6; 162/181.5; 162/182

[58] Field of Search ... 162/157.6, 146, 9, 181.1–181.6, 162/181.9, 182, 183, 100, 138, 139

[56] References Cited

U.S. PATENT DOCUMENTS 2,547,948 4/1951 Kornei ..... 162/138
4,234,378 11/1980 Iwasaki et al. ..... 162/138
4,510,020 4/1985 Green et al. ..... 162/181.1

FOREIGN PATENT DOCUMENTS 53-38704 4/1978 Japan ..... 162/138

*Primary Examiner*—Peter Chin
*Attorney, Agent, or Firm*—Swabey Ogilvy Renault

[57] ABSTRACT

Magnetic paper-forming fibers have a particulate magnetic material incorporated within the fibers, as distinct from between the fibers; this can be achieved by loading the lumens of cellulosic fibers with magnetic particles or by generating magnetic particles in situ in a paper-forming fiber which contains ionic groups effective for ion exchange with ferrous ions; the fibers can be employed to produce single layer or multi-layererd magnetic papers for information storage, security paper applications, paper handling, reprographic applications such as magnetographic printing substrate as well as for speciality uses such as electromagnetic shielding, magnetic separation of antibodies based on selective adsorption.

21 Claims, 6 Drawing Sheets

PREPARATION AND SYNTHESIS OF MAGNETIC FIBERS

BACKGROUND OF THE INVENTION 1 i) Field of the Invention

This invention relates to a cellulosic magnetic mass and paper products produced therefrom, and to processes for producing the cellulosic magnetic mass.

2 ii). Description of Prior Art

Maghemite (y-$Fe_2O_3$) is the most widely used iron oxide in the production of magnetic recording media. Others are magnetite ($Fe_3O_4$), chromium dioxide ($CrO_2$) and cobalt-doped oxides. A common application for maghemite is in the form of a thin layer on plastic substrates such as Mylar for making diskettes. A similar application for ferrites is the encoding of information on subway tickets in the form of a thin magnetic strip coated on the cardboard stock. Magnetic inks or magnetic xerographic toners are an important element in the laser printing of magnetically encoded images. The acronym MICR for Magnetic Ink Character Recognition adequately describes the technology.

Japanese Patent No. 200 000/85 and No. 247 593/85, issued Oct. 9, and Dec. 7, 1985, respectively, describe magnetic paper produced either by mixing pulp with ferrite or by coating finished paper with ferrite mixed with a binder. A surface magnetic layer on a paper support has practical applications but interstitial loading of ferrite between fibers to create bulk magnetism is quite detrimental to papermaking. Filler particles adsorbed on external fiber surfaces interfere with interfiber bonding, thus reducing paper strength. Furthermore, poor retention results in losses during handling, yielding a dirty product.

U.S. Pat. No. 4,510,020 describes papers of improved strength and opacity which contain a particulate mineral, for example, white titanium dioxide, which confers high light reflectance to the paper and thus increases both opacity and brightness; the loss of strength normally associated with the inclusion of such particulate mineral between the fibers of the paper and consequent reduction of fiber-to-fiber bonds is overcome by incorporating the particulate material within the lumens of the cellulosic fibers of the paper.

U.S. Pat. No. 4,474,866 describes in situ preparation of ferrites in polymers.

Magnetic paper-forming fibers would have a number of applications including: magnetic papers, both single and multi-layered, for security paper applications, paper holding (blocking), and in reprographic applications such as paper handling, paper sensing, information storage, and magnetographic printing substrate. In addition such fibers have application in speciality uses such as magnetic separation of antibodies based on selective adsorption.

SUMMARY OF THE INVENTION

It is an object of this invention to provide a cellulosic magnetic mass suitable for forming magnetic papers.

It is a further object of this invention to provide magnetic paper products.

It is still a further object of this invention to provide processes for producing the cellulosic magnetic masses of the invention.

In accordance with the invention a cellulosic magnetic mass comprises a plurality of cellulosic fibers in which each fiber has an exterior surface, and a particulate magnetic material incorporated within the fibers of the plurality. In particular the particles of magnetic material are within individual fibers of the plurality and spaced or disposed inwardly of the exterior surfaces of the fibers.

In another aspect of the invention there is provided a magnetic paper which comprises a paper layer composed of a formed cellulosic magnetic mass of the invention.

In still another aspect of the invention there is provided a process for producing a cellulosic magnetic mass which comprises providing a plurality of cellulosic fibers and incorporating particulate magnetic material within individual fibers of the plurality.

In accordance with the invention the particles of magnetic material are incorporated completely within the fibers and the cellulosic mass and the papers formed therefrom are substantially free of magnetic particles on the exterior surfaces of the fibers and between adjacent fibers.

DESCRIPTION OF PREFERRED EMBODIMENTS

(i) Lumen Loaded Fibers

(a) Fibers

The cellulosic fibers employed in the invention in a first embodiment are in particular papermaking fibers and the preferred fibers are derived from wood and are produced by pulping the wood. These fibers are typically elongated, tubular members of generally uniform cross-section throughout most of their length but tapered at their ends. Each fiber has a fiber wall having an outwardly facing exterior face and an inwardly facing interior face which defines a generally central cavity or lumen of the fiber. The fiber wall is perforated by small apertures or pits which interconnect the lumen and the exterior face.

These fibers are more particularly described in U.S. Pat. No. 4,510,020, the teachings of which are incorporated herein by reference.

(b) Magnetic Material

The magnetic material may be any particulate magnetic material, for example, particulate iron oxides and chromium dioxide, and modifications thereof.

Iron oxides which may be employed include $Fe_2O_3$ including synthetic $\gamma$-$Fe_2O_3$ and naturally occurring maghemite and $Fe_3O_4$ including synthetic $Fe_3O_4$ and naturally occurring magnetite.

The particle size should be such that the particles will pass through the apertures of the fiber wall and enter the lumen, or will enter the lumen at the lumen orifices. Particles having a size of 0.1 to 1 $\mu$m have been found to produce good results.

(c) Lumen Loading Process

The fibers may be lumen loaded with particulate magnetic material following the procedure described in U.S. Pat. No. 4,510,020, the teaching of which is incorporated by reference, but employing particulate magnetic material in place of the opacifiers or brighteners of the U.S. patent.

Generally, this procedure involves a first stage of impregnating the fibers with the magnetic particles by agitating an aqueous suspension of the fibers and particles. Impregnation is typically achieved in 5 to 60 minutes depending on how vigorously the suspension is agitated; and a second stage of washing the impregnated fibers removed from the suspension by filtering; in this second stage the impregnated fibers are separated from residual magnetic particles including magnetic particles adhering to the exterior face of the fibers.

(ii) In Situ Loaded Fibers

In this embodiment of the invention the fibers may be natural fibers with certain functional groups or chemically modified cellulose fibers. Such fibers include carboxymethylated cellulose fibers, sulfated cellulose fibers and sulfonated lignocellulosic fibers. Other natural biopolymer papermaking fibers can be employed which either have appropriate ionic groups or can be chemically modified to carry ionic groups for the ion exchange with ferrous ions. Other suitable fibers include continuous filament alginic acid; sodium alginate; cross-linked gels of sulfonic acid-containing polysaccharides; iron-complexing polysaccharides, for example, chitosan; and oxidized particulate carbohydrate polymers, for example, starch.

In a particular illustrative embodiment these fibers are sodium carboxymethyl cellulose fibers which can be dispersed in water to yield a gel which functions as a host matrix for ion-exchange with ferrous ($Fe^{2+}$) ions.

The host matrix is contacted with an aqueous ferrous salt solution, for example, aqueous ferrous chloride to achieve ion exchange between the sodium ions and the ferrous ions. Addition of a stoichiometric amount of aqueous sodium hydroxide solution precipitates ferrous hydroxide in the matrix. The ferrous hydroxide is oxidized to magnetic particles of iron oxide and this may be achieved by bubbling oxygen through the gel matrix. The gel is dried to a mass of sodium carboxymethyl cellulose fibers in which fine particles of $Fe_3O_4$ are incorporated within the fiber wall.

The process is schematically illustrated as follows:

1. Ion exchange $$\left\{\begin{matrix}COO^-Na^+\\COO^-Na^+\end{matrix}\right. + FeCl_2 \xrightarrow[25^\circ C.]{H_2O} \left\{\begin{matrix}COO^-\\COO^-\end{matrix}\right. Fe^{2+} + 2\ NaCl$$

CMC gel brown floc

2. Precipitation $$\left\{\begin{matrix}COO^-\\COO^-\end{matrix}\right. Fe^{2+} + 2\ NaOH \xrightarrow[25^\circ C.]{H_2O} \left\{\begin{matrix}COONa\\COONa\end{matrix}\right. + Fe(OH)_2$$

emerald-green floc

3. Oxidation $$3\ Fe(OH)_2 + \tfrac{1}{2}O_2 \xrightarrow[\text{Stir at } 65^\circ C. \text{ for } 2\text{ hrs}]{H_2O} Fe_3O_4 + 3\ H_2O$$

The product of this process was a parchment-like brown film which could be picked up by a permanent bar magnet. Vibrating Sample Magnetometer (VSM) measurements showed that these films had an S-shaped hysteresis loop which passed through the origin; i.e., no remanent magnetization. X-ray and electron diffraction revealed that the superparamagnetic pigment (~200 Å by TEM) is either $\gamma$-$Fe_2O_3$ or magnetite.

Using the Na-carboxymethylcellulose fiber originally developed for water retention applications, superparamagnetic particles have been synthesized in the cellulosic matrix, and the matrix has been converted to a parchment-like membrane. This approach has wide application for converting biopolymers, especially polysaccharides with amino, carboxyl, sulfate and sulphonic acid groups, into magnetically responsive particles, fibers and film materials.

(iii) Magnetic Papers

The magnetic particles employed in the present invention are typically red-brown, brown or black particles and as such they represent an unusual particle for introduction into paper in which a white or pale colour is usually required.

The previous attempts to produce magnetic papers by incorporation of magnetic material in the paper resulted in dirty products which have not been exploited commercially.

The procedure of U.S. Pat. No. 4,510,020 was directed to producing papers of improved brightness and whiteness using a white pigment such as titanium dioxide, so that the use of dark coloured particles such as the magnetic particles of the invention would not be appropriate following the teachings of the U.S. patent.

It is found in accordance with the invention that a layer of magnetic paper-forming fibers can be laminated to one or more layers of non-magnetic paper-forming fibers, for example, bleached kraft fibers to produce a laminated paper of acceptable brightness and whiteness without loss of the magnetic properties of the layer of magnetic fibers.

Thus where a light coloured magnetic paper is required, lamination of a magnetic fiber layer to a bleached, non-magnetic fiber layer is an acceptable solution in accordance with the invention.

It is also found that inclusion of pigments to effect brightening, whitening or colouring, in a magnetic paper formed from magnetic fibers of the invention does not interfere with the magnetic intensity of the paper.

Thus the invention contemplates papers derived solely from the magnetic paper-making fibers of the invention, with or without conventional paper additives, for example, brightening, whitening and colouring pigments; as well as laminated papers in which a layer of magnetic paper-making fibers is covered on one or both sides by one or more layers of non-magnetic paper-making fibers, especially bleached fibers.

Papers produced from magnetic fibers of the invention have elastic properties comparable with similar non-magnetic papers, and the presence of the magnetic particles has no significant effect on the elastic properties.

The lumen-loaded magnetic fibers of the invention are found to align in a magnetic field and the anisotropy of the fibers can be manipulated to yield axially oriented papers.

Applications for a magnetic paper of the invention include information storage on magnetographic or security paper and new methods of paper handling and paper sensing in copiers. Lumen-loading appears more attractive for information storage than in situ synthesis because ferrimagnetic particles can retain induced magnetization (remanence). However, the in situ approach has the potential of providing magnetic effects with smaller particle sizes and less colourations for biotechnological separations where remanence is usually not desirable.

EXAMPLES

Example 1

Figure 1:
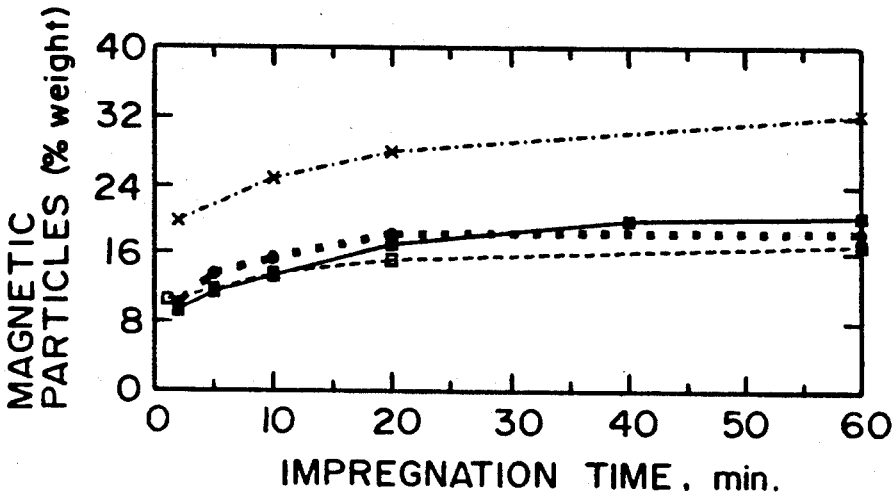
FIG. 1 shows adsorption curves typical of Langmuir loading behaviour for lumen-loading with magnetic particles in accordance with the invention.

Black spruce (Picea Mariana) softwood was used to produce an unbleached kraft pulp, (kappa number=30) and a chemi-thermomechanical pulp (CTMP) for lumen-loading experiments. The CTMP (Sprout-Bauer refiner) was hot disintegrated (Domtar disintegrator) and fractionated in order to remove fines, while the unbleached kraft was fiberized in a British disintegrator and washed in a Bauer-McNett classifier. The magnetic particles studied are listed in Table 1. Electrophoretic mobilities were examined to semi-quantitatively determine the surface charges.

TABLE I

| Magnetic particles | Characteristics of magnetic particles. $\gamma$-$Fe_2O_3$ (synthetic) | $CrO_2$ (synthetic) | $Fe_3O_4$ (natural) | $Fe_3O_4$ (synthetic) |
|---|---|---|---|---|
| Trade name | Pferrox MO-2228 | D-500-03 | MO-8029 | Mapico black #SL-1942 |
| Supplier | Pfizer Inc. | DuPont de Nemours | Pfizer Inc. | Columbian Chemicals Canada |
| Color | Orange-Brown | Black | Dark brown | Dark brown |
| Particle shape | acicular | acicular | variable | variable |
| Particle size ($\mu$m) | ~0.4 | ~0.3 | 0.1-1.0 | ~0.5 |
| acicular ratio | 6:1 | 10:1 | N.A. | N.A. |
| Electrophoretic mobility ($10^{-8}m^2s^{-1}V^{-1}$) | −2.4 | −2.2 | −2.6 | −3.5 |
| Specific saturation moment, EMU/g | 75 | 74 | 83 | 83 |
| Coercivity($H_c$), Oe | 310 | 490 | 320 | 300 |

Each filler suspension was prepared by dispersing 15 g of magnetic particles in 750 ml of deionized water (i.e., filler concentration=20 g/l). The filtered (to eliminate large particles) magnetic particle suspension was then poured into a dynamic drainage jar (DDJ) which consists of two screwed parts: a cylinder with baffles and a filter (125 mesh) base equiped with an outlet valve. The moist equivalent of 7.5 g of dry pulp was added to the filler suspension (yields consistency=1%) and the mixture was subjected to agitation at 1000 rpm (impregnation stage). Following impregnation, washing was done (to remove surface adhering magnetic particles) at a 21/min. water flow until the effluent was reasonably free of magnetic particles, after about 25-30 minutes. High turbulence (1000 rpm) was necessary to wash the refined pulps while less agitation (800 rpm) was used for the chemical ones. Optical microscopy, with dark field illumination, was also used to follow the cleanliness of the exterior surfaces of the fibers and for photomicrography.

Pulp samples were oven-dried (105° C.) overnight and their ash content determined after combustion at 925° C. during 4 hours. The values were corrected for the ash content of the fibers; i.e., an average of 0.66% ash for the CTMP and 0.4% for the unbleached kraft. Finally, since combustion causes oxidation state changes for magnetite and chromium dioxide, adsorptions (100×g magnetic particles/g fibers) were adjusted using an experimentally determined gravimetric factor GF. During combustion, reactions occur according to:

$$2CrO_2 \rightarrow Cr2O_3 + \tfrac{1}{2}O_2 \quad (4)$$

$$2Fe_3O_4 + \tfrac{1}{2}O_2 \rightarrow 3Fe_2O_3 \quad (5)$$

thus, adsorption of magnetic particles was calculated using the following equation:

$$\text{Adsorption}_{\%\ weight} = 100 \times \frac{\%\ \text{ash}_{total} - \%\ \text{ash}_{pulp}}{GF(100 - \%\ \text{ash}_{total})} \quad (6)$$

Handsheets were made, without further disintegration, and tested in accordance with the standard methods of the Technical Section of the Canadian Pulp and Paper Association (CPPA).

Hysteresis loops were measured using a computerized Foner-type VSM for weighed ~10 mg) paper samples with their surface parallel to the horizontally applied DC magnetic field. In this technique, the sample vibrates vertically and the dipole field of the sample induces an AC signal in a pair of coils which is proportional to the magnetization of the sample. The apparatus is calibrated using high purity Ni which has a magnetization of 54.4 EMU/g at room temperature. The maximum saturation field was set to 0.5 T and specific magnetic moments were obtained directly in EMU/g.

FIG. 1 shows adsorption curves typical of "Langmuir" loading behavior; adsorption increases as a function of time and finally reaches a plateau. In general, an optimal level of loading is obtained after 20 minutes. Maximum adsorption for a CTMP is in the range of 16–20%, except for one magnetic material which loads up to 32%. The latter is characterized by a change in surface charge after the impregnation stage: the magnetic material became positive. Because cellulose in water is negatively charged, particle-to-fiber interaction in the lumen-loading process can be expected to depend on mechanical and kinetic factors as well as electrostatics as shown by S. R. Middleton et al (Colloids and Surfaces, 16: 309–322, 1985). The mechanism of particle-to-fiber interaction is optimized for a favourable combination of electrostatic and van der Waals forces, and the lumen-loading of magnetic particles should be maximized by these two effects simultaneously. In addition, the adsorption mechanism seems to be dependent on the particle shape, and it was observed that acicular magnetic particles were more difficult to wash (from external surfaces) than "variable" ones. In fact, we had to use a much higher turbulence (an additional 15 min. at 1500 rpm) during washing of $\gamma$-$Fe_2O_3$ to be able to observe the Langmuir behavior because under normal circumstances, a horizontal line was obtained for different impregnation times.

When refined and chemical pulps were compared, higher levels of loading were obtained for the CTMP, even though requirements for lumen-loading are better met with the unbleached kraft pulp. The Mapico magnetic particles, for instance, loaded up to 26% with the unbleached kraft pulp and up to 32% with the CTMP.

Figure 2:
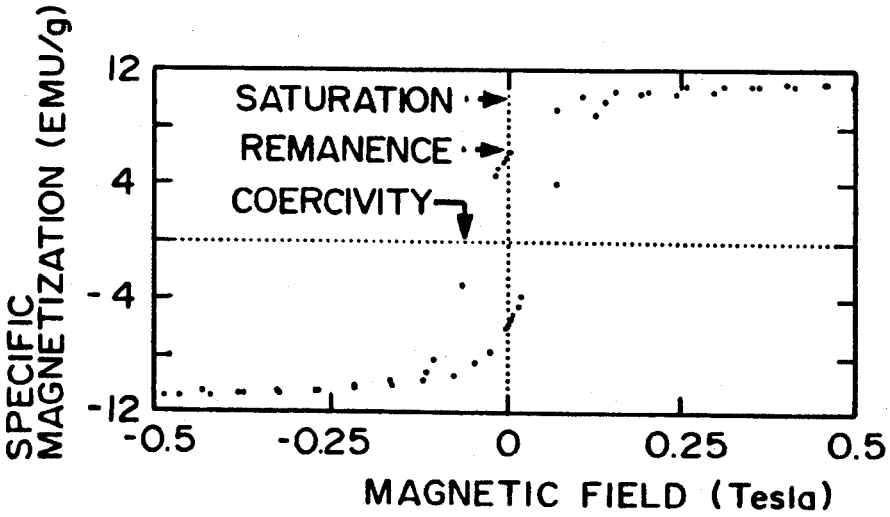
FIG. 2 is a typical hysteresis loop showing the magnetic properties of lumen-loaded magnetic fibers of the invention.

FIG. 2 represents in a typical hysteresis loop the magnetic properties of these specialty fibers. The measured specific saturated magnetization, which is less than that of the pure magnetic particles, parallels the ash measurement results. On the other hand, the coercive force, i.e., the field strength to bring back the remanent magnetization to zero, is unaffected by the levels of loading.

Example 2

Black spruce (Picea Mariana) softwood was used to produce an unbleached kraft pulp. The never-dried pulp was lumen-loaded with synthetic $Fe_3O_4$ (see Table 1). The pulp was prepared in the Paprican facilities in Montreal to a yield of 49%. A bleached kraft pulp (Stone Consolidated) beaten in a Valley beater at 300 ml CSF was used as a non-magnetic protective surface layer to enhance the durability and chemical stability of the magnetic layer with enhancement of the optical properties of the overall paper.

Each magnetic particle suspension was prepared by dispersing 15–45 g of the particles in 250 ml of deionized water (DIW) with a laboratory mechanical stirrer. The suspension, was then poured in the disintegrator with the moist equivalent of 15 g of pulp defiberized 5 min. in 1250 ml of DIW, i.e., pulp consistency = 1%. The mixture of magnetic particles having a concentration of 10–40 g/l, and the pulp suspension was subjected to turbulent agitation (3000 rpm) in a standard British disintegrator. This action is carried out for 10–30 min. during which magnetic particles enter the lumens and also become attached to the fiber exteriors. Following impregnation, the particles on the fiber exterior are removed by washing at a 6 l/min. tap water flow in a Bauer McNett classifier unit, equipped with a 100 mesh screen, during 30 minutes. Ash content was used as a measure of the degree of lumen-loading with correction for the ash content of the fiber itself (typically 0.5% ash).

Kraft bleached pulp was disintegrated (5 min. using hot water) in a British disintegrator and diluted to about 3 g/l in the external tank of the pulp supply system. Lumen-loaded pulp was diluted to about 3 g/l in the internal tank of a NORAM Dynamic Sheet Former (D.S.F.). The D.S.F. is a laboratory centrifugal sheet-forming machine based on the "Formette Dynamique" developed by the Centre Technique de l'Industrie des Papiers, Cartons et Cellulose, Grenoble, France, described in ATIP No. 6 (16): 446–453, 1962. Several studies have been reported by Sauret et al. on good correlation of MD-CD ratio of strength properties between commercial and sheet-former-made papers. The operating conditions of the D.S.F. can be set up to reproduce the fiber orientation of a Fourdrinier machine through the entire MD-CD plane, and fines distribution in the Z-direction as shown by Anczurowski et al (Pulp and Paper Canada 84 (12): 112–115 (1983)).

The pulp supply system allowed production of multi-layered structures for up to four different pulp stocks. The pulp was then delivered from the nozzle (#SS2504) to the wire (Unaform 2-ply U-64438 NORAM 84×60) after forming the "water wall". The nozzle angle was fixed at 15° and the distance from the wire at 20 mm. The number of nozzle sweeps was adjusted to give a predetermined basis weight for each layer. The jet speed and the drum speed were kept constant at 690 to 1100 m/min. respectively to obtain preferential fiber orientation in the machine direction (MD). The wet sheets having a solids content of about 13%, by weight, were pressed with two passes at 700 kPa in between two new blotters in each pass on a laboratory press giving a sheet of about 40%, by weight, solids. The "sandwich" was then dried to about 5% moisture in a laboratory drier under canvas tension.

Figure 3:
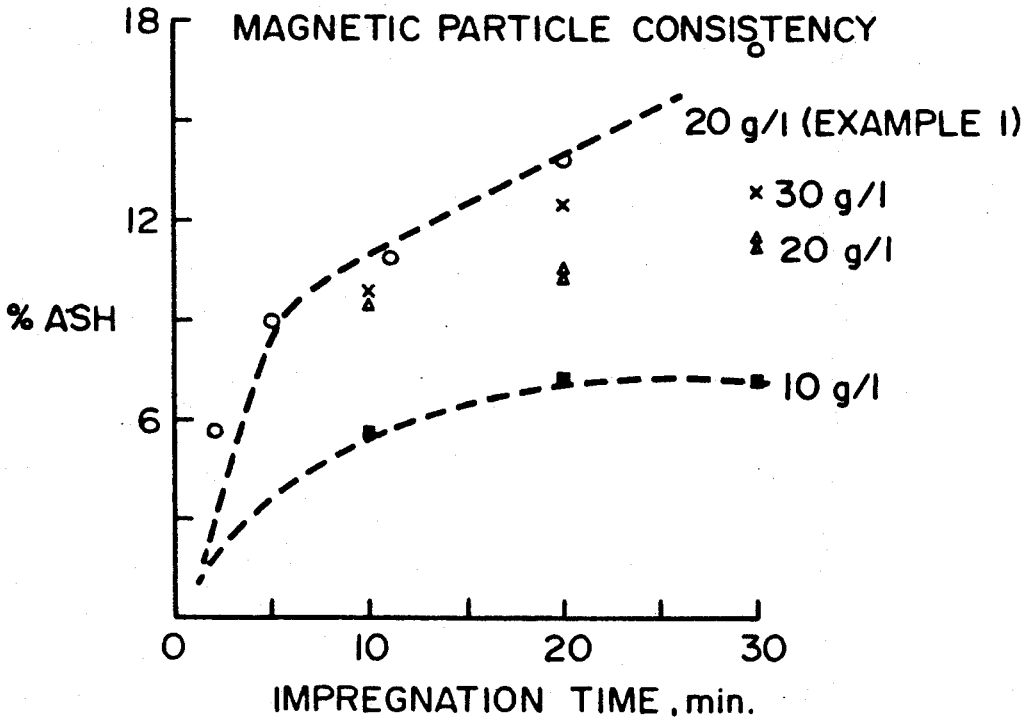
FIG. 3 shows adsorption curves of loading.

FIG. 3 shows adsorption curves of loading where optimum adsorptions of $Fe_3O_4$ are in the range of 10% (20g/l), except for loading up to 18% from Example 1, where the washing step was less efficient.

The use of Bleached Kraft pulp (BK) in lamination is to improve the brightness and sheet formation. The paper formation is characterized by in-plane elastic properties determined by measuring the velocity of ultrasound (60 kHz) in paper using a robot based instrument developed by the Institute of Paper Chemistry (IPC Technical Series No. 304, Sep. 1988). The engineering elastic constants are calculated according to Baum et al., TAPPI 64(8): 97–101, Aug. 1981 and APPITA 40(4): 288–204, Jul. 1987:

$$E_x = E_{MD} = pV_{Lx}^2(1 - U_{xy}U_{yx}) = C_{11}(1 - U_{xy}U_{yx})$$

$$E_y = E_{CD} = pV_{LY}^2(1 - U_{xy}U_{yx}) = C_{22}(1 - U_{xy}U_{yx})$$

$$R_{xy} = C_{11}/C_{22}$$

$$G_{xy} = a(E_xE_y)^{\frac{1}{2}}$$

where, $E_x$, $E_y$ = sonic Young's moduli corresponding to the machine and cross-machine direction respectively;

p = apparent density of paper;

$V_{Lx}^2$ = squared bulk longitudinal velocity in the x direction;

$U_{xy}$ = Poisson's ratio (ratio of the lateral contraction in the x direction to the axial extension in the y direction when the material is stressed uniaxially in the y direction);

$C_{ij}$=elastic stiffness coefficients;
$R_{xy}$=MD-CD stiffness ratio or anisotropy ratio;
$G_{xy}$=shear modulus in the xy plane;
$a^{-1}=2(1+(U_{xy}U_{yx})^{\frac{1}{2}})$.

Figure 4:
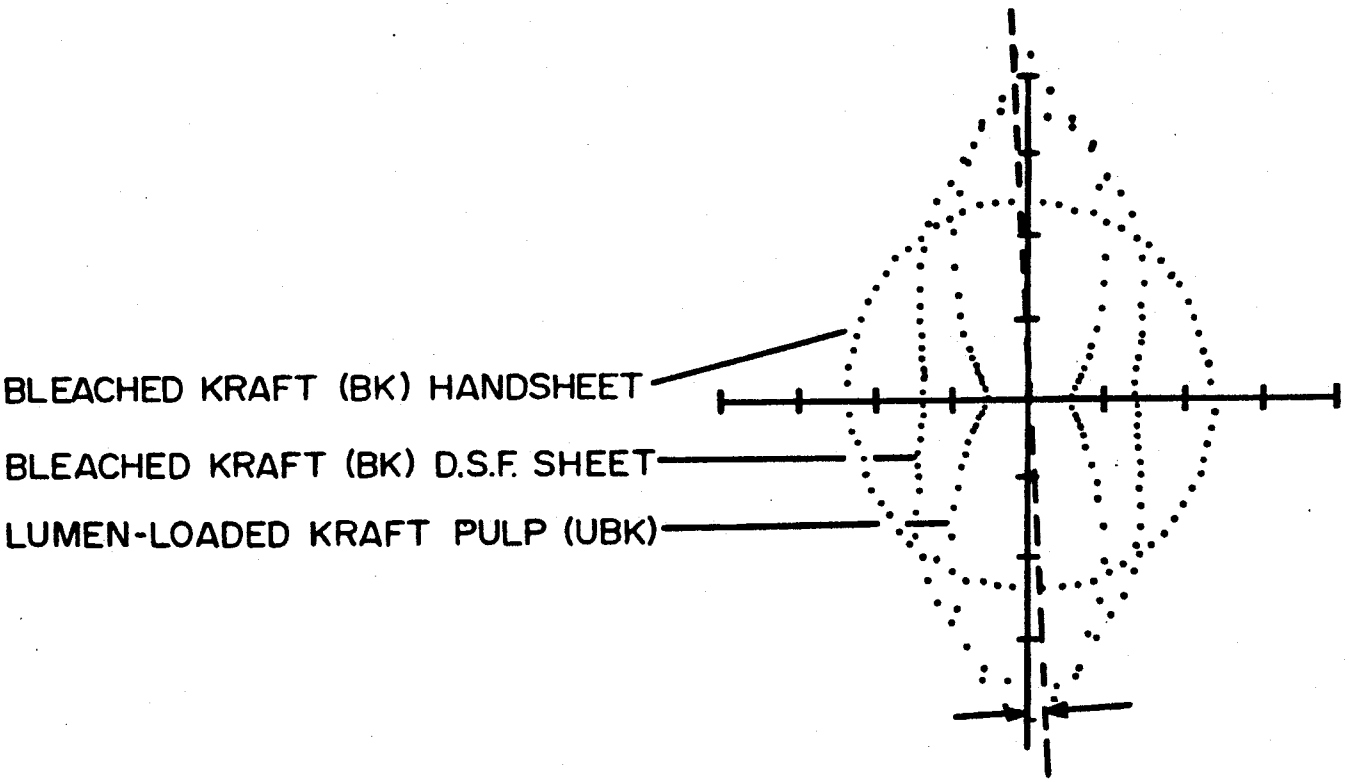
FIG. 4 shows polar plots of ultrasound squared velocity for different paper sheets including a lumen-loaded magnetic paper sheet of the invention.

FIG. 4 shows polar plots of ultrasound squared velocity for magnetic oriented structure D.S.F. sheets compared with a BK randomly oriented speed ratio and degree of restraint during drying, the lumen-loaded spruce fibers tend to align in the MD more easily than the shorter and finer BK fibers. Furthermore, all plots of the laminated sheets fall in between the 100% BK and 100% lumen-loaded unbleached black spruce kraft pulp.

At similar dewatering conditions, which in this case were similar wet pressing pressures, the BK fibers network presents more fiber-to-fiber contacts per fiber, then an increase in the bonded area per fiber, and therefore has higher elastic moduli than the lumen-loaded UBK as shown in Table II.

Since coarser fibers have thicker cell walls, and are few per gram, black spruce fibers (UBK) are less flexible, and resist collapse. They make more porous and permeable network. Therefore, it appears that lumen-loading does not change the sonic elastic engineering parameters but affects slightly the elastic moduli ($E_x$, $E_y$) determined by tensile test.

TABLE II

Sonic elastic engineering parameters for D.S.F. sheets containing 0-100% lumen-loaded fibers and for standard handsheet. (*) = Values determined by INSTRON tensile test.

| SAMPLES PARAMETERS | 100% BK | 100% UBK | 100% UBK Lumen Loaded | 10% UBK Lumen Loaded 3 Layers | 30% UBK Lumen Loaded 3 Layers | 40% UBK Lumen Loaded 2 Layers | BK Standard Handsheet |
|---|---|---|---|---|---|---|---|
| $V^2_{Lx}$, mm²/μsec² | 17,90 | 21,50 | 19,41 | 18,75 | 17,69 | 17,62 | 12,28 |
| $V^2_{Ly}$, mm²/μsec² | 6,68 | 2,91 | 2,55 | 5,66 | 5,75 | 4,96 | 11,70 |
| ρ, g/cm³ | 0,63 | 0,52 | 0,58 | 0,64 | 0,60 | 0,54 | 0,30 |
| B, g/m² | 63 | 70 | 62 | 72 | 65 | 67 | 40 |
| $R_{xy}$ | 2,7 | 7,5 | 7,5 | 3,1 | 3,1 | 3,5 | 1,05 |
| $U_{xy}$ | 0,167 | 0,192 | 0,188 | 0,138 | 0,166 | 0,145 | 0,253 |
| $U_{yx}$ | 0,434 | 1,065 | 1,106 | 0,434 | 0,518 | 0,488 | 0,267 |
| $E_x$, (*), GPa | 10,5(7,2) | 8,9(8,6) | 8,9(7,0) | 11,3(8,5) | 9,7(7,6) | 8,8(6,7) | 3,45 |
| $E_y$, (*), GPa | 3,9(2,7) | 1,2(1,5) | 1,2(1,2) | 3,6(3,0) | 3,1(2,7) | 2,5(2,2) | 3,3 |
| $G_{xy}$, GPa | 2,5 | 1,1 | 1,1 | 2,5 | 2,1 | 1,8 | 1,3 |
| B.L MD, km (*) | 17,6 | 16,3 | 13,3 | 18,2 | 16,7 | 13,2 | — |
| B.L CD, km (*) | 4,3 | 2,4 | 2,4 | 4,1 | 3,6 | 3,2 | — |
| ΔL/L MD, % (*) | 4,0 | 2,4 | 2,4 | 3,7 | 3,5 | 3,2 | — |
| ΔL/L CD, % (*) | 3,4 | 3,4 | 3,2 | 3,7 | 3,0 | 3,0 | — |

However, the D.S.F. sheets exhibit substantially a decrease in sheet apparent density with an increase in lumen-loaded fibers content. The increase in coarser fibers tend to produce a mat with a higher proportion of uncollapsed fibers, and therefore produce a sheet with lower Young's moduli and breaking length. The results also show that sheet lamination offers an excellent opportunity for developing superior stiffness in the machine direction of lumen-loaded papers as is required in numerous printing processes. The specific saturation moment intensity measured, which is a fraction of that for the pure magnetic particles, is a good physical value to compare with the ash measurement result while the coercive force, i.e., the field strength to bring back the remanent magnetization to zero, is similar to that of the pure magnetic particles. The preliminary results show that the papers exhibit smaller remanence and coercive force than typical information storage media such as the floppy disks or buspass tickets as shown in Table III.

TABLE III

Magnetic properties of papers made with $Fe_3O_4$ lumen-loaded fibers and typical media storage.

| SAMPLES PARAMETERS | 100% UBK Lumen Loaded | 10% UBK Lumen Loaded 3 Layers | 30% UBK Lumen Loaded 3 Layers | 40% UBK Lumen Loaded 2 Layers | BUS CARD | FLOPPY DISK |
|---|---|---|---|---|---|---|
| $\sigma_s$, EMU/g | | | | | | |
| VSM | 7,2 | 0,9 | 2,0 | 3,0 | 5,2 | 1,7 |
| Xerox | 6,8 | 0,7 | 1,8 | 2,8 | 5,5 | — |
| $\sigma_r$, EMU/g | 1,25 | 0,15 | 0,3 | 0,5 | 2,4 | 1,0 |
| $H_c$, Oe | 140 | 175 | 160 | 155 | 390 | 1400 |
| $\sigma_r/\sigma_s$ | 0,17 | 0,17 | 0,17 | 0,17 | 0,46 | 0,57 |
| % ash | 8,4 | 0,5 | 2,1 | 3,3 | — | — |

Example 3

The physico-chemical conditions during and/or after the impregnation stage should promote bond formation between magnetic particles and the lumen surfaces S.R. Middleton et al, (Colloids and Surfaces. 16: 309-322, 1985) showed that a combination of van der Waals and attractive electrostatic forces between a positively charged particle and a negatively charged fiber surface provided favorable attraction between fibers and particles. The electrophoretic mobilities given in Table IV show $\gamma$-$Fe_2O_3$ particles to be negatively charged from pH 3 to 10, while the pulp fibers themselves are also negatively charged.

TABLE IV

Electrophoretic mobility of $\gamma$-$Fe_2O_3$ as a function of pH in $H_2O$, $10^{-8}m^2v^{-1}.S^{-1}$.

| pH | 3 | 4 | 5 | 6 | 7 | 8 | 9 | 10 |
|---|---|---|---|---|---|---|---|---|
| E.M. | −0.8 | −1.5 | −1.6 | −1.6 | −2.4 | −2.3 | −1.9 | −1.7 |

Alum ($Al_2(SO_4)_3.18H_2O$) is widely used in the paper industry as an effective additive for changing the surface charge to encourage the electrostatic attraction between particles in suspension and the pulp fibers. Addition of retention aids took place in two ways:

before lumen-loading, using up to 0.5 g/l alum;

after lumen-loading, polyethylenimine (PEI polymin SK Trade-Mark of BASF) was used as retention aid.

The post-treatment with PEI was 0–4% weight/weight polymer on pulp and was carried out at pH of 5.5–6. After slow stirring for 30 min.–24 hrs., the pulp was washed in the Bauer McNett unit as described in Example 2.

Figure 5:
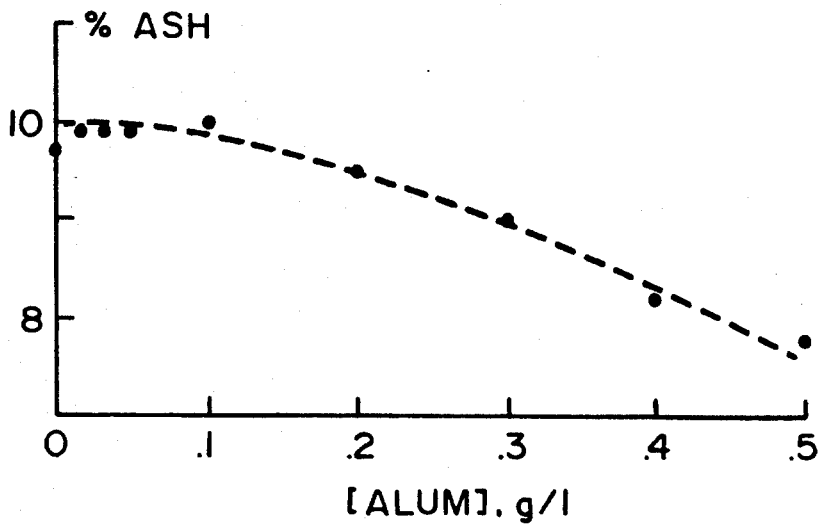
FIG. 5 is a plot of magnetic particle adsorption as a function of alum concentration.

FIG. 5 shows an adsorption curve for maghemite (20 min., 20 g/l) as a function of alum concentration. The effect of alum on surface charge of particles appears to be negative re. lumen-loading.

The adsorption value decreases from 10% at 0.1 g/l alum to approximately 8% at 0.5 g/l. The poorer retention of magnetic particles with increasing alum concentration is likely due to their greater flocculation during lumen-loading. Electrophoretic mobility studies also show y-$Fe_2O_3$ to be negatively charged at alum concentrations between 0.1 to 0.3 g/l, with an average mobility of $-2.0\pm0.3$ ($\times10^{-8}$) $m^2V^{-1}S^{-1}$ at pH 7, which contributes to the detrimental effect on lumen-loading.

S. R. Middleton et al (Journal of Pulp and Paper Science 15 (6): J229–J235, Nov. 1989), demonstrated that cationic polyacrylamide (0.5% w/w polymer on pulp) can be used before $TiO_2$ loading to increase lumen-loading by 50%; also a post-treatment with polymer (1.5% w/w polymer or pulp) improved the resistance to unloading during the washing step. M. L. Miller et al (Journal of Pulp and Paper Science 11 (3): J84–J88, May 1985), found that the treatment of lumen-loaded fibers with cationic polyethylenimine was effective in increasing $TiO_2$ retention in fiber lumens.

Experiments were carried out to determine the minimum treatment time required for optimum retention and the minimum PEI concentration needed for optimum effectiveness.

Figure 6:
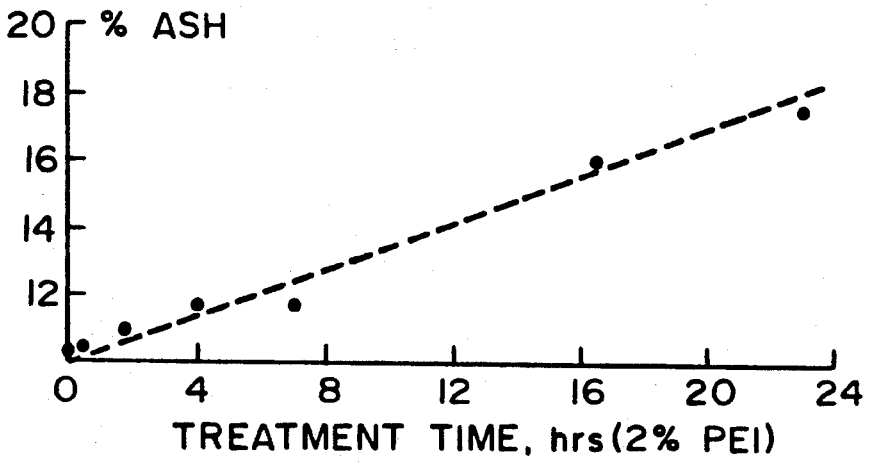
FIG. 6 is a plot illustrating retention of magnetic particles.

FIG. 6 shows the effect of stirring pulp, lumen-loaded at pH 6 in the presence of 0.1 g/l alum, with 2% PEI at pH 5.0–5.5 for varying lengths of time. As the post-treatment with 2% PEI increases from 30 mins. to 23 hours, the magnetic particle adsorption increased from about 10% to 18%.

The higher magnetic particle retention at a lower PEI concentration (0.5%) is likely due to the fibers becoming positive while the magnetic particles are still negative. (See B. Alince on $TiO_2$ retention, Colloids and Surfaces, 23:119–120, 1987 and 33:79–288, 1988). Thus, surface charge reversion yields better retention due to attractive electrostatic forces. Additionally, a polymer layer over particle coated surfaces anchors the weakly bound particles to the more strongly bound ones (heterocoagulation). A pulp which is both highly loaded and highly resistant to unloading could result also from the flocculant effect (homoflocculation or coagulation) preventing unloading of particles via the pit apertures in the fiber wall. During the preparation of pulps and magnetic paper with a 21% lumen-loaded unbleached kraft pulp with y-$Fe_2O_3$ at pH 6 in 0.1 g/l alum, followed by slow stirring with 0.5% PEI at pH 5.5 for 23 hours, high centrifugal forces expulsed weakly bonded particles. In the Dynamic Sheet Former, a final retention of 86% was obtained during the papermaking with lumen-loaded fibers. Since the magnetic fibers tended to flocculate, a more diluted pulp suspension was used to prevent blockage of spray nozzle and to improve sheet formation. The magnetic properties of paper (specific magnetization at saturation, $\sigma_s$, the remanent magnetization, $\sigma_r$, and the coercive force, $H_c$) shown in Table V are calculated from the hysteresis loops obtained for each sample using a VSM. The $\sigma_r$ and $H_c$ parameters were determined by linear regression of the data from 0.05 T to $-0.05$ T on the hysteresis loop. Whereas $\sigma_s$ and $\sigma_r$ are dependent on the quantity of magnetic particles loaded in the fibers, $H_c$ and $\sigma_r/\sigma_s$ should be the same for the magnetic paper and the type of magnetic material. The magnetic properties of the y-$Fe_2O_3$ lumen-loaded are superior to those exhibited by sheets loaded with $Fe_3O_4$. For papers containing the same percentage of lumen-loaded pulp, sheets loaded with y-$Fe_2O_3$ show twice the magnetic saturation and approximately 5 times the remanent magnetization of those loaded with $Fe_3O_4$. Furthermore, the magnetic properties (i.e., remanence and coercivity) of these sheets are comparable to those observed for subway passes and computer floppy disks.

TABLE V

Magnetic properties of papers made with $\gamma$-$Fe_2O_3$ lumen-loaded fibers and typical media storage.

| SAMPLES PARA-METERS | 100% UBK Lumen Loaded | 20% UBK Lumen Loaded 2 Layers | 50% UBK Lumen Loaded 2 Layers | BUS CARD | FLOPPY DISK |
|---|---|---|---|---|---|
| $\sigma_s$, EMU/g | 12,7 | 2,6 | 6,1 | 5,2 | 1,7 |
| $\sigma_r$, EMU/g | 6,5 | 1,3 | 3,1 | 2,4 | 1,0 |
| $H_c$, Oe | 650 | 650 | 640 | 390 | 1400 |
| $\sigma_r/\sigma_s$ | 0,51 | 0,51 | 0,50 | 0,46 | 0,57 |
| % ash | 17,8 | 3,4 | 8,8 | — | — |

Figure 7:
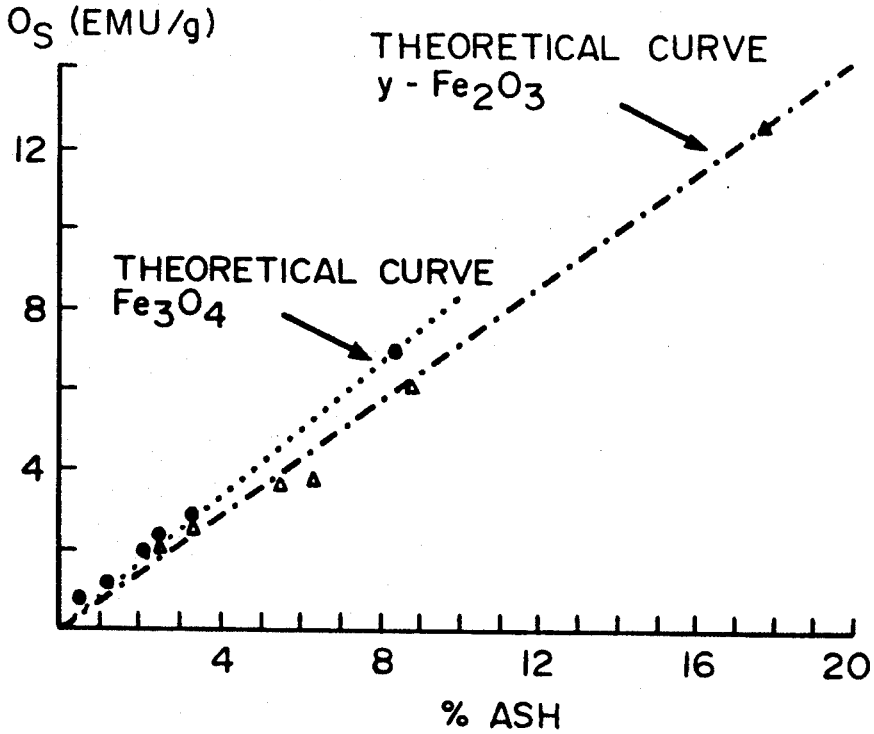
FIG. 7 is a plot of % ash content of a magnetic multilayered paper against specific magnetization at saturation.

In FIG. 7, the ash content of the magnetic multilayered papers is plotted against the measured $\sigma_s$. The linear relationship which exists shows that clay and increasing amounts of bleached kraft pulp added to improve the optical properties of the sheets do not interfere with their magnetic response. Thus, the result is paper (lumen-loaded with y-$Fe_2O_3$) with a high level of magnetic properties (i.e. remanence and coercivity) and adequate brightness.

Furthermore, a non-destructive EDXA (Energy Dispersive X-Ray Analysis) method has been used to characterize the proportion of ferrites in the paper samples since any element with an atomic number higher than 10 can be detected with this technique.

Figure 8:
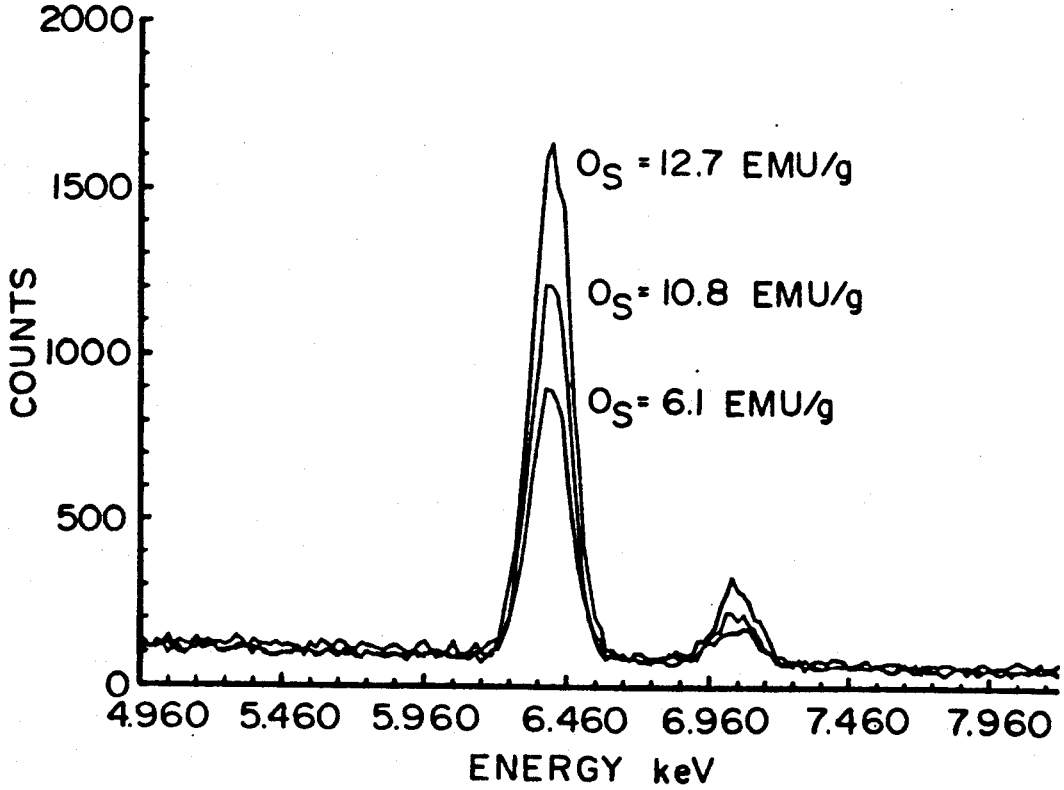
FIG. 8 is an EDXA spectra of magnetic papers of the invention.

FIG. 8 illustrates EDXA spectra (4.96–7.96 keV) of magnetic papers at 300×magnification. The number of counts is plotted on a vertical full scale of 2000 as a function of energy. The peak intensity is well correlated with $\sigma_s$ and the ash content.

Example 4

A sample of Na-carboxymethylcellulose (Na-CMC) known as CLD-2 (The Buckey Cellulose Corp., U.S.A.), was used in the form of lap pulp. Its carboxyl content was characterized by conductometric titration which yielded $2.82\pm0.03$ eq/Kg of carboxylate groups corresponding to a degree of substitution of 0.6. For comparison, a sample of chemi-thermomechanical pulp which was titrated in similar fashion yielded $113\pm5$ meq./Kg. of carboxylate.

A 3.0 g sample of CLD-2 dry lap pulp was dispersed in 300 ml of deionized water to yield a gel-like matrix of 10 g/L consistency. To this system was added an aqueous solution of $FeCl_2.4H_2O$ of 0.28 g/20 ml. After 5 mins. of stirring to allow ion exchange a brownish yellow coloration developed, this was followed by stoichiometric precipitation of ferrous hydroxide in the gel by adding 25 ml of 0.112M NaOH. After gentle stirring a uniform "green rust" coloration developed which was consolidated by heating for 30 mins. at 65° C. on a hot bath. Finally, for 2 hours oxygen was bubbled into the dispersion at a rate of 6–10 ml. $O_2$/min. with gentle stirring conditions under a nitrogen atmosphere.

The product was washed by centrifugation to eliminate excess NaCl and concentrated to a gel consistency suitable for spreading and drying. After drying on a glass surface, a parchment-like film was obtained with good toughness and paper-like hand.

The following schematic outlines the steps involved in the above-described synthesis of sodium carboxymethylcellulose fibers having magnetic properties:

1. Ion exchange $$\left\{\begin{matrix}\text{COO}^-\text{Na}^+\\ \text{COO}^-\text{Na}^+\end{matrix}\right. + \text{FeCl}_2 \xrightarrow[25^\circ\text{ C.}]{\text{H}_2\text{O}} \left\{\begin{matrix}\text{COO}^-\\ \text{COO}^-\end{matrix}\right. \text{Fe}^{2+} + 2\ \text{NaCl}$$

CMC gel brown floc

2. Precipitation $$\left\{\begin{matrix}\text{COO}^-\\ \text{COO}^-\end{matrix}\right. \text{Fe}^{2+} + 2\ \text{NaOH} \xrightarrow[25^\circ\text{ C.}]{\text{H}_2\text{O}} \left\{\begin{matrix}\text{COONa}\\ \text{COONa}\end{matrix}\right. + \text{Fe(OH)}_2$$

emerald-green floc

3. Oxidation $$3\ \text{Fe(OH)}_2 + \tfrac{1}{2}\text{O}_2 \xrightarrow[\text{Stir at 65° C. for 2 hrs}]{\text{H}_2\text{O}} \text{Fe}_3\text{O}_4 + 3\ \text{H}_2\text{O}$$

Under the above stated experimental conditions the dry product film displayed a specific magnetization at saturation of 2.0±0.1 EMU/g which is about 67% of what one would calculate for 100% yield based on the original added $FeCl_2.4H_2O$. If time of oxidation or $O_2$ input are varied secondary reactions tend to diminish the main oxidation product which X-ray diffraction, electron diffraction and photoacoustic infrared spectroscopy clearly identified as $Fe_3O_4$ (magnetite).

Figure 9:
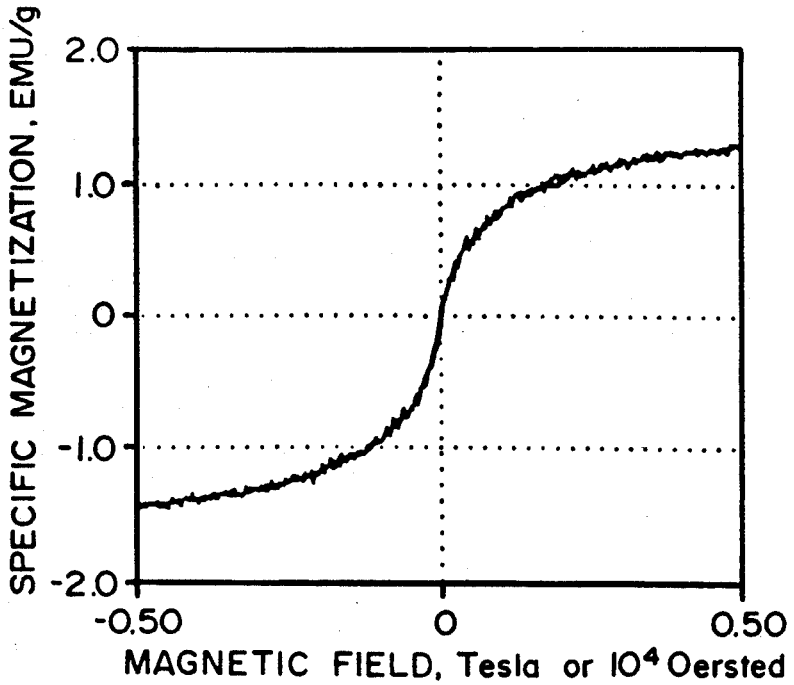
FIG. 9 is a hysteresis loop of a superparamagnetic film composite of the the invention.

The analysis of the magnetic films/paper using a classical vibrating sample magnetometer instrument (EG & G Princeton Applied Research) provided quantitative evidence concerning the magnetic properties. FIG. 9 shows the specific magnetization as a function of the applied field. This typical S-shaped curve passes directly through the origin, indicating that these materials are superparamagnetic, i.e., do not display the remanence and coercivity phenomena characteristic of commercial ferrites used in information storage applications. This is attributed to the small size of the in situ synthesized particles which is also responsible for the relatively light brown colour compared to commercial synthetic magnetite particles which are 10–100 times larger.

Transmission electron microscopy on ultrasound dispersed samples of the wet gel provided a picture of tiny thin crystals, well-dispersed. An average size of about 100 Å was estimated for the particles which appeared plate-like. The appearance of these crystals is similar to what has been reported previously in such a matrix controlled synthesis (U.S. Pat. No. 4,474,866). Larger crystals and higher loadings could be expected by performing repeated cycles of reaction on the fiber suspension.

Since CLD-2 fibers have been midly cross-linked, they swell to a limit of about 25 times their weight in water, even though the level of carboxymethylation would normally result in dissolution. Furthermore, the lap pulp sheet was laid down from the methanol suspension so that the original dry fibers appear unswollen. After swelling and drying onto a solid substrate, the fibers collapsed and bond into a porous parchment-like film. The magnetite particles are dispersed in this matrix which on exposure to X-ray diffraction analysis provided a powder pattern typical of $Fe_3O_4$.

Example 5

Figure 10:
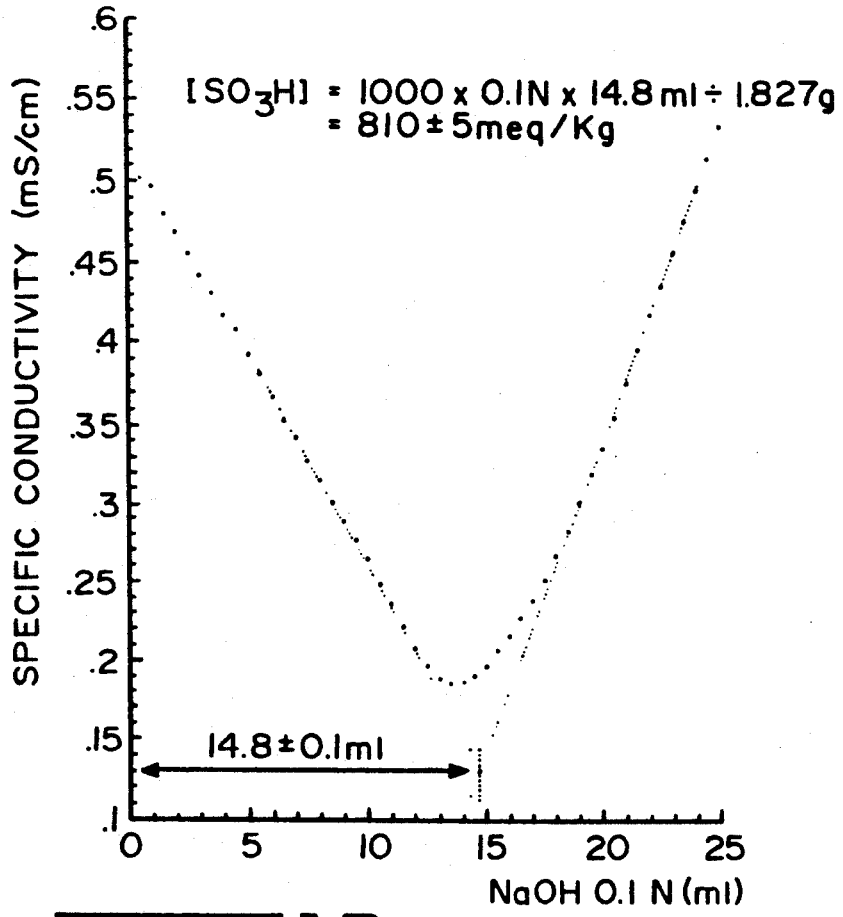
FIG. 10 is a conductometric titration curve of a highly sulfonated wood pulp.

The conductometric titration curve of a highly sulfonatee pulp shown in FIG. 10 gives 810 meq/kg sulfonic groups available for the in situ synthesis of magnetic particles.

A 3 g highly sulfonated pulp was dispersed in 300 ml deionized water (10 g/l) and then mixed with $FeCl_2.4H_2O$ in excess. After dispersion during 30 minutes for ion exchange, precipitation of $Fe(OH)_2$ occured in the fibers using 8.1 ml NaOH 0.1M.

1. Ion exchange $$\left\{\begin{matrix}\text{SO}_3\text{H}^-\\ \text{SO}_3^{-2}\end{matrix}\right. + 1\tfrac{1}{2}\text{FeCl}_2 \xrightarrow[25^\circ\text{ C.}]{\text{H}_2\text{O}} \left\{\begin{matrix}\text{SO}_3\text{H}^-\\ \text{SO}_3^{-2}\end{matrix}\right. 1\tfrac{1}{2}\text{Fe}^{2+} + 3\ \text{HCl}$$

2. Precipitation $$\left\{\begin{matrix}\text{SO}_3\text{H}^-\\ \text{SO}_3^{-2}\end{matrix}\right. 1\tfrac{1}{2}\text{Fe}^{2+} + 3\ \text{NaOH} \xrightarrow[25^\circ\text{ C.}]{\text{H}_2\text{O}} \left\{\begin{matrix}\text{SO}_3\text{H}^-\text{—Na}^+\\ \text{SO}_3^{-2}\text{—2Na}^+\end{matrix}\right. + 1\tfrac{1}{2}\text{Fe(OH)}_2$$

3. Oxidation $$3\ \text{Fe(OH)}_2 + \tfrac{1}{2}\text{O}_2 \xrightarrow[\text{Stir at 65° C. for 2 hrs}]{\text{H}_2\text{O}} \text{Fe}_3\text{O}_4 + 3\ \text{H}_2\text{O}$$

incomplete oxidation $$2\ \text{Fe(OH)}_2 + \tfrac{1}{2}\text{O}_2 \xrightarrow[\text{Stir at 65° C. for 2 hrs}]{\text{H}_2\text{O}} \text{Y—Fe}_2\text{O}_3 + 3\ \text{H}_2\text{O}$$

slow oxidation

The suspension was gently mixed and heated at 65° C. Iron oxides were formed by oxidation with an oxygen flow of 10 ml/min under nitrogen atmosphere during a 2 hours period. After multiple washing steps and filtration, the magnetic fibers were dried at room temperature.

Example 6

A papermaking technique was used to produce a paper product with magnetic fibers of Example 4 as an air filter having barrier properties for magnetic dusts. The said filter exhibited a high efficiency of retention of suspended magnetic and magnetizable fine particles. Recovery of the particles from the filter was possible.

Example 7

A manual papermaking technique was used to produce an art paper made with magnetic fibers of Example 4. These fibers were deposited in such a way that the production of an image in the wet paper forming stage was possible. A hand-held sheet-machine screen was used to attract the magnetic fibers under a magnetic field to produce a pattern.

The deposition of magnetic fibers preceded the final deposition of a white or colored background furnish. The furnish covered the magnetic signature and the sheet was pressed and air-dried to yield a permanent unique magnetic art document.

Example 8

A papermaking technique was used to produce a paper product with magnetic fibers of Example 4 acting as a protective magnetic shield. For sensitive electronic equipment or materials exposed to a magnetic field there is need for deflection of an external field to avoid changes in properties or damage.

For health and safety reasons, large area inexpensive magnetic shielding is needed. This invention provides an inexpensive way to convert magneteic particles into large area sheets.

Example 9

A papermaking technique was used to produce a security paper product with magnetic fibers of Example 4. The operating conditions of a Fourdrinier paper machine can be set up to deposit a continuous narrow strip of lumen-loaded magnetic fibers. The rate of deposition of said magnetic layer was controlled by the jet speed and the concentration of the said magnetic lumen-loaded fiber suspension. The mean angle of magnetic fiber orientation was controlled by the jet to wire speed ratio.

The process yields a paper product with similar physical properties as conventional paper but which can be authentified by magnetic sensor devices. A wide range of magnetic patterns can be laid down by appropriate design.

Example 10

In reprographic paper handling systems, one has need for so-called "smart paper" which has the appearance and properties of conventional paper but which can be sensed by magnetic, conductive or optical devices. The sensor then signals a mechanical or electronic device to bring about a change relating to imaging, developing or printing.

In another embodiment of this application, the sensor can cause a change in paper handling such that the paper path is changed and a new reprographic operation is initiated. Magnetic paper, with or without a bleached pulp overcoat to improve optical properties, can serve in this way. By being sensed through a magnetic device which creates an electric signal, the operations described above are initiated. Usually the "smart paper" is placed in a certain numerical order in a pile of paper sheets.

We claim:

1. A method of producing magnetic papermaking fibers comprising:
   - providing a biopolymer papermaking fiber mass of fibers having ionic groups bearing cations which undergo ion exchange with ferrous ions,
   - contacting the fiber mass with an aqueous ferrous salt solution and allowing ion exchange to proceed between said cations and said ferrous ions,
   - precipitating said ferrous ions as ferrous hydroxide within said fibers,
   - oxidizing the ferrous hydroxide to form fine particles of magnetic iron oxide within said fibers, and drying the fiber mass.

2. A method according to claim 1 wherein said fibers are of sodium carboxymethylcellulose.

3. A method according to claim 1 wherein said fibers are sulfated cellulosic fibers.

4. A method according to claim 1 wherein said fibers are sulfonated lignocellulose fibers.

5. A method according to claim 1 wherein said fibers comprise continuous filament alginic acid fibers.

6. A method according to claim 1 wherein said fibers comprise sodium alginate fibers.

7. A method according to claim 1 wherein said fibers comprise a cross-linked gel of a sulfonic acid-containing polysaccharide.

8. A method according to claim 1 wherein said fibers are of an iron-complexing polysaccharide.

9. A method according to claim 1 wherein said fibers are of an oxidized particulate carbohydrate polymer.

10. A method according to claim 2 wherein said ferrous salt is ferrous chloride, and said oxidizing comprises bubbling oxygen through the ferrous hydroxide within the fibers.

11. A magnetic biopolymer papermaking fiber mass of fibers containing free particles of magnetic iron oxide within said fibers produced by contacting a fiber mass of biopolymer papermaking fibers having ionic groups bearing cations which undergo ion exchange with ferrous ions, with an aqueous ferrous salt solution, allowing ion exchange to proceed between said cations and said ferrous ions, precipitating said ferrous ions as ferrous hydroxide within said fibers, oxidizing the ferrous hydroxide to form fine particles of magnetic iron oxide within said fibers, and drying the fibers.

12. A magnetic mass according to claim 11 wherein said fibers are of sodium carboxymethylcellulose.

13. A magnetic mass according to claim 11 wherein said fibers are sulfated cellulosic fibers.

14. A magnetic mass according to claim 11 wherein said fibers are sulfonated lignocellulose fibers.

15. A magnetic mass according to claim 11 wherein said fibers comprise continuous filament alginic acid fibers.

16. A magnetic mass according to claim 11 wherein said fibers comprise sodium alginate fibers.

17. A magnetic mass according to claim 11 wherein said fibers comprise a cross-linked gel of a polysaccharide.

18. A magnetic mass according to claim 11 wherein said fibers are of an iron-complexing polysaccharide.

19. A magnetic mass according to claim 11 wherein said fibers are of an oxidized particulate carbohydrate polymer.

20. A magnetic paper comprising a layer of biopolymer papermaking fibers containing fine particles of magnetic iron oxide within said fibers, said fibers being produced by contacting a fiber mass of biopolymer papermaking fibers having ionic groups bearing cations which undergo ion exchange with ferrous ions, with an aqueous ferrous salt solution, allowing ion exchange to proceed between said cations and said ferrous ions, precipitating said ferrous ions as ferrous hydroxide within said fibers, oxidizing the ferrous hydroxide to form fine particles of magnetic iron oxide within said fibers, and drying the fibers.

21. A magnetic paper according to claim 20, further including at least a second layer of bleached, non-magnetic, cellulosic fibers laminated to said layer.

* * * * *